US005785407A

United States Patent [19]

Ratcliffe et al.

[11] Patent Number: 5,785,407

[45] Date of Patent: Jul. 28, 1998

[54] ILLUMINABLE CONTAINER

[75] Inventors: William R. Ratcliffe, Thousand Oaks, Calif.; William Blake Ratcliffe, Berwick, Canada

[73] Assignee: Marpole International Inc., Central Hong Kong, Hong Kong

[21] Appl. No.: 751,234

[22] Filed: Nov. 18, 1996

[51] Int. Cl.[6] ..... F21V 33/00

[52] U.S. Cl. ..... 362/101; 362/806; 362/800; 40/324

[58] Field of Search ..... 362/101, 806, 362/800; 40/324, 463

[56] References Cited

U.S. PATENT DOCUMENTS

| | | | |
|---|---|---|---|
| 2,663,866 | 12/1953 | Simpson | 362/101 |
| 5,119,279 | 6/1992 | Makowsky | 362/101 |
| 5,178,450 | 1/1993 | Zelensky et al. | 362/101 |
| 5,339,548 | 8/1994 | Russell | 362/101 |

*Primary Examiner*—Thomas M. Sember
*Attorney, Agent, or Firm*—Fulwider Patton Lee & Utecht, LLP

[57] ABSTRACT

A container having a bottom, a side wall and a rim defining the container top can be filled with a fluid such as water. An enclosure holding an energy source (e.g. a battery) and a switch is disposed at the container bottom, preferably within the container. A resilient cover on the enclosure defines a movable contact of the switch and provides open and closed states with a fixed contact within the enclosure. A member disposed externally of the enclosure and defining an electrical circuit with the energy source and the switch becomes illuminated in accordance with the flexing of the cover. A button disposed at the container bottom extends through the container bottom in a sealed relationship with the container bottom and engages the resilient cover when the container is disposed with a particular force on a support surface or when the container on the support surface becomes at least partially filled with fluid. An emblem on the container side, preferably contiguous to the illuminable member, becomes illuminated when the member becomes illuminated. A second enclosure holding an energy source and a switch has a construction corresponding to that disclosed above. The second enclosure is disposed on a tab of a lid which is pivotably mounted on the container rim. When the tab is manually engaged to pivot the lid to the open position, a light emitting member external of such enclosure becomes illuminated to illuminate an emblem on the lid. The emblem on the lid may be replaceable.

19 Claims, 7 Drawing Sheets

ILLUMINABLE CONTAINER

This invention relates to illuminable containers. More particularly the invention relates to containers which can be filled with a fluid such as water and which can be illuminated with a particular message either at the side of the container or on a lid at the top of the container.

BACKGROUND OF THE INVENTION

When an individual is drinking a soft drink at a hamburger stand or at a sporting event, it would be desirable if the container holding the soft drink could be illuminated to display the particular soft drink which is in his glass. This would probably increase the drinker's enjoyment of the beverage. It would probably also be a significant advertising ploy for the brewer of the beverage. Until now, no one has been able to illuminate such a container on a satisfactory basis.

BRIEF DESCRIPTION OF THE INVENTION

In one embodiment of the invention, a container having a bottom, a side wall and a rim defining the container top can be filled with a fluid such as water. An enclosure holding an energy source (e.g. a battery) and a switch is disposed at the container bottom, preferably within the container. A resilient cover on the enclosure defines a movable contact of the switch and provides open and closed states with a fixed contact within the enclosure.

A member disposed externally of the enclosure and defining an electrical circuit with the energy source and the switch becomes illuminated in accordance with the flexing of the cover. A button disposed at the container bottom extends through the container bottom in a sealed relationship with the container bottom and engages the resilient cover when the container is disposed with a particular force on a support surface or when the container or the support surface becomes at least partially filled with fluid. An emblem on the container side, preferably contiguous to the illuminable member, becomes illuminated when the member becomes illuminated.

A second enclosure holding an energy source and a switch has a construction corresponding to that disclosed above. The second enclosure is disposed on a tab of a lid which is pivotably mounted on the container rim. When the tab is manually engaged to pivot the lid to the open position, a light emitting member external of such enclosure becomes illuminated to illuminate an emblem on the lid. The emblem on the lid may be replaceable.

Figure 4:
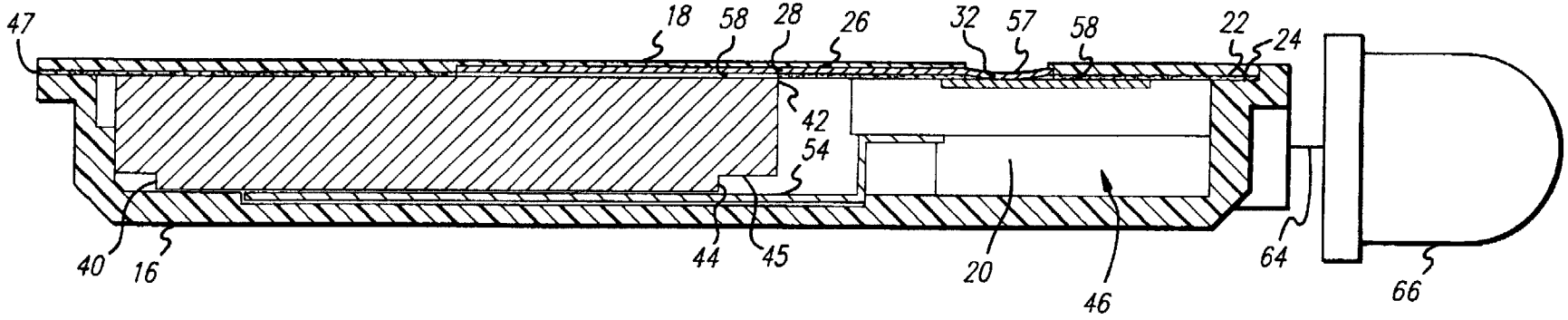
FIG. 4 is an enlarged sectional view taken substantially on the line 4—4 of FIG. 1 with the cover disposed on the enclosure.

In one embodiment of the invention, a casing 16 and a cover 18 (FIG. 4) define an enclosure 20. The casing may be provided with a depth of approximately one eighth of an inch (⅛"), a length of approximately one and one quarter inches (1¼") and a width of approximately one inch (1"). The casing 16 has a ledge 22 at its upper surface. The cover 18 is disposed on the ledge 22 and is provided with a layer 24 of an adhesive at positions on its inner surface to engage the ledge and produce a seal with the casing. The cover 18 is relatively thin and is provided with resilient or flexible characteristics. A conductive layer generally indicated at 26 (FIG. 1) and made from a suitable material such as silver or carbon is disposed on the inner surface of the cover 18. The conductive layer 26 is provided with a central contacting portion 28, a connecting portion 30 and a peripheral contacting portion 32.

The casing 16 is divided by a wall 34 (FIG. 1) into a pair of compartments 36 and 38. The compartment 36 is annular to receive in a nested relationship an energy source such as a battery generally indicated at 40. The battery 40 may be a lithium type of battery well known in the art. The battery 40 may have a radially enlarged portion 42 (FIG. 4) and radially undercut portion 44. The portions 42 and 44 define the two (2) terminals of the battery 40. The bottom periphery of the compartment 36 may be stepped upwardly as at 45 to receive the undercut portion 44 of the battery in a snug relationship. The radially enlarged portion 42 of the battery 40 is displaced from the central contacting portion 28 of the conductive layer 26 when the cover 18 is disposed on the casing 16. This results from the application of an adhesive 47 to the underside of the cover 18 to seal the cover to the casing 16.

A printed circuit board generally indicated at 46 is disposed in a nested relationship in the compartment 38 of the casing 16. The printed circuit board 46 is disposed in a particular relationship in the compartment 38 as by mating male portions 48 in the peripheral walls of the compartment with female portions in the peripheral portion of the printed circuit board. The printed circuit 46 is spaced from the bottom of the casing 16 as by risers 52 disposed at the corners of the compartment 38. This provides for the disposition at the bottom of the compartment 38 of a resilient conductive member 54 (FIG. 5) which is made from a suitable material such as copper.

The conductive member 54 is connected at one end to electrical circuitry 56 in the printed board 46 and is disposed at the other end against the terminal 44 of the battery 40. A resilient conductive member 55 attached to the printed circuit board 46 engages the annular side periphery of the terminal 42 in the battery 40. The conductive portion 32 of the conductive layer 26 engages the electrical circuitry 56 on the printed circuit board 46. This is facilitated by dimpling the cover 18 at the position of the conductive portion 32 as indicated at 57 in FIG. 4.

The electrically conductive portion 28 of the conductive layer 26 defines a switch 58 (FIGS. 5 and 6) with the portion 42 of the battery 40. The switch 58 may have open and closed relationships and may be normally in the open relationship. The switch 58 may be constructed to become operative in the closed relationship only as a result of a force against the cover 18. When this occurs, the cover 18 is depressed at the position of the conductive portion 28 of the conductive layer 26 so that the conductive portion 28 engages the battery 46.

Figure 1:
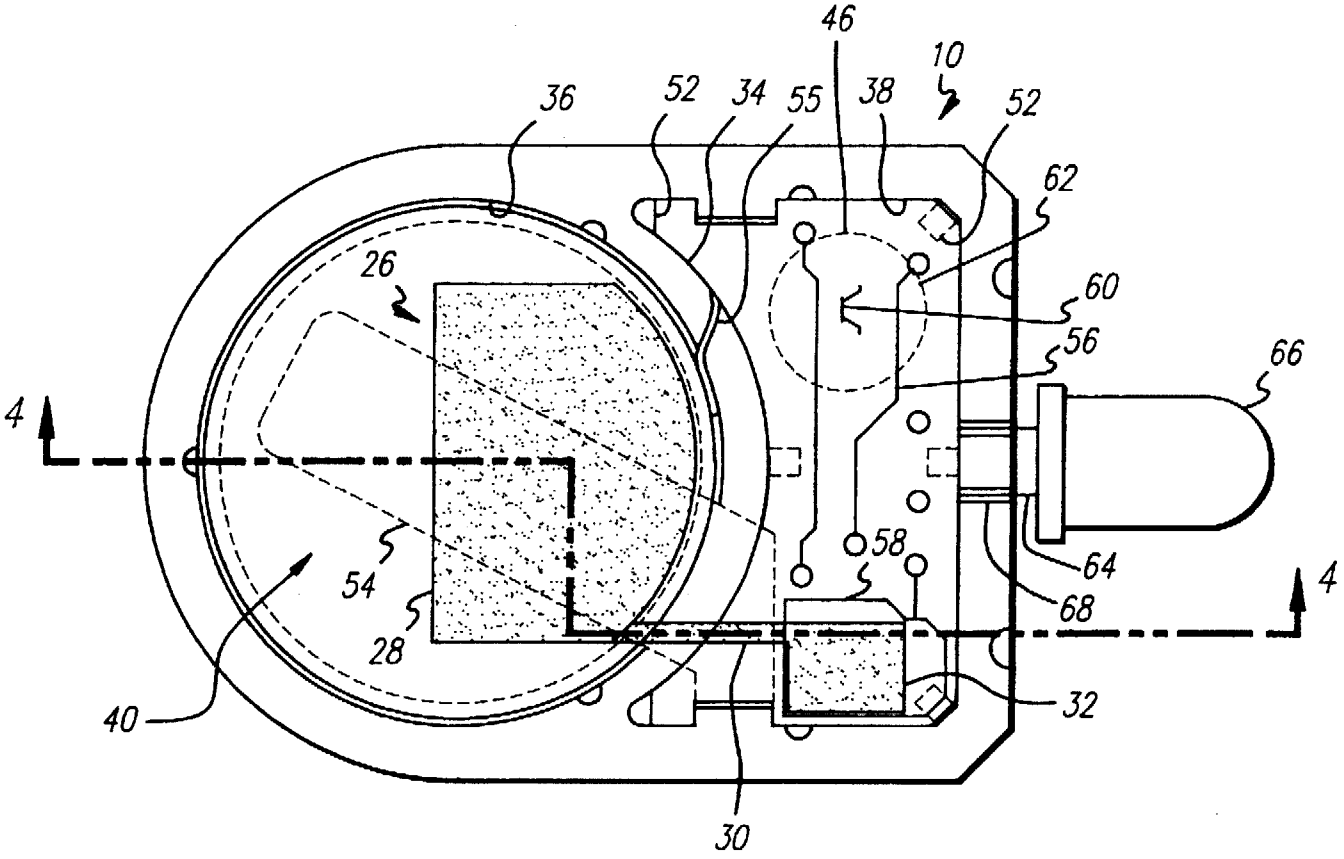
FIG. 1 is a top plan view of an enclosure including a casing and members in the casing for providing an illumination.
Figure 2:
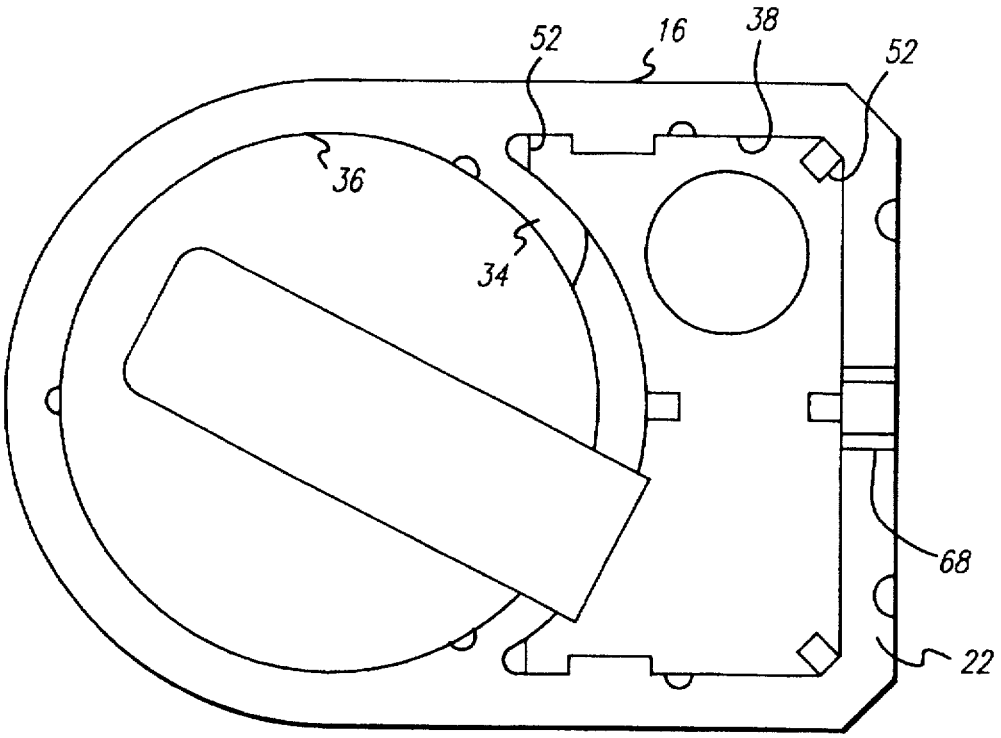
FIG. 2 is a top plan view of the enclosure and the members in the enclosure with a cover removed from the enclosure and with a battery disposed in an individual compartment in the enclosure.
Figure 3:
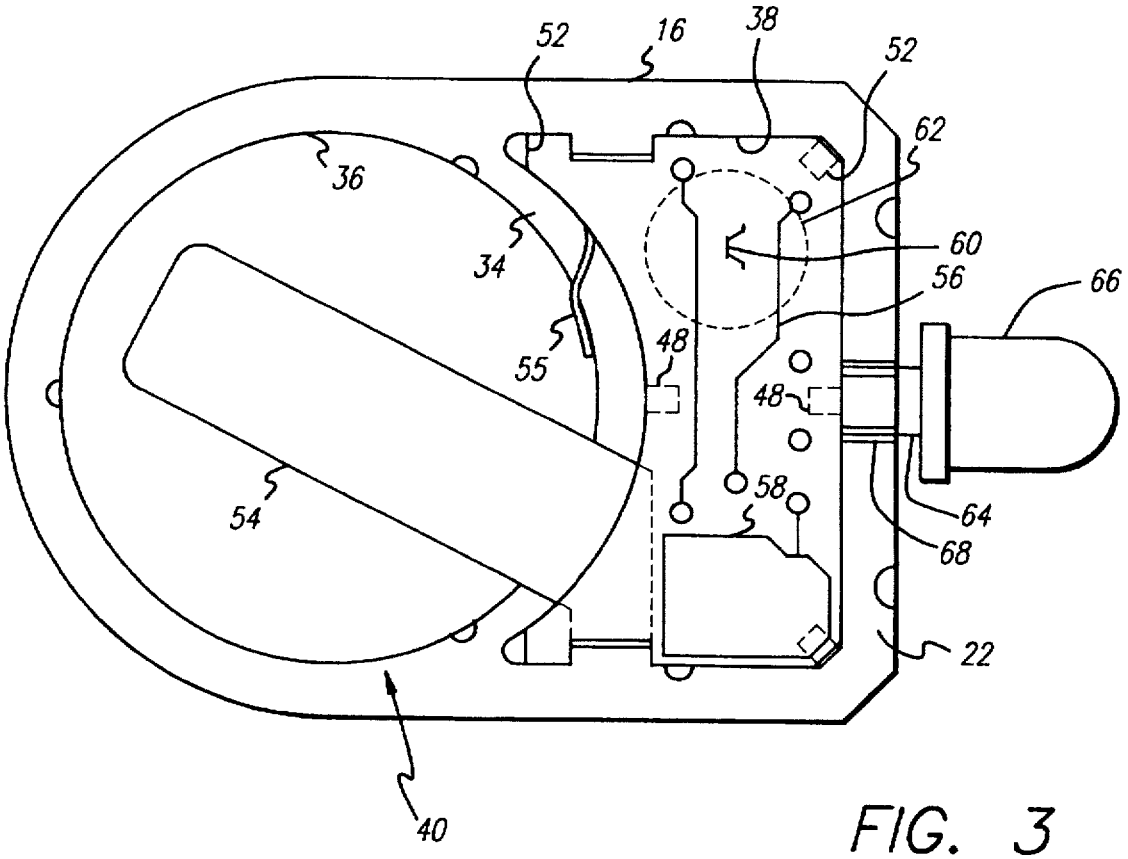
FIG. 3 is a top plan view of the enclosure and the members in the enclosure with the cover removed in the enclosure and with the battery in the individual compartment in the enclosure and with a printed circuit board in another individual compartment in the enclosure.

The electrical circuitry 56 may constitute an application specific integrated circuit (ASIC) including a transistor 60 (FIG. 1). The ASIC may be covered with a blob 62 of a suitable material such as an epoxy to protect the ASIC. Electrical leads 64 from an illuminating member such as a light emitting diode 66 are attached to appropriate terminals on the printed circuit board 46. The leads 64 are disposed in cuts 68 in the casing 16. The body (the illuminating portion) of the diode 66 is preferably disposed externally of the casing 16 so that the light from the diode can be easily seen from a position external to the enclosure 20.

Figure 5:
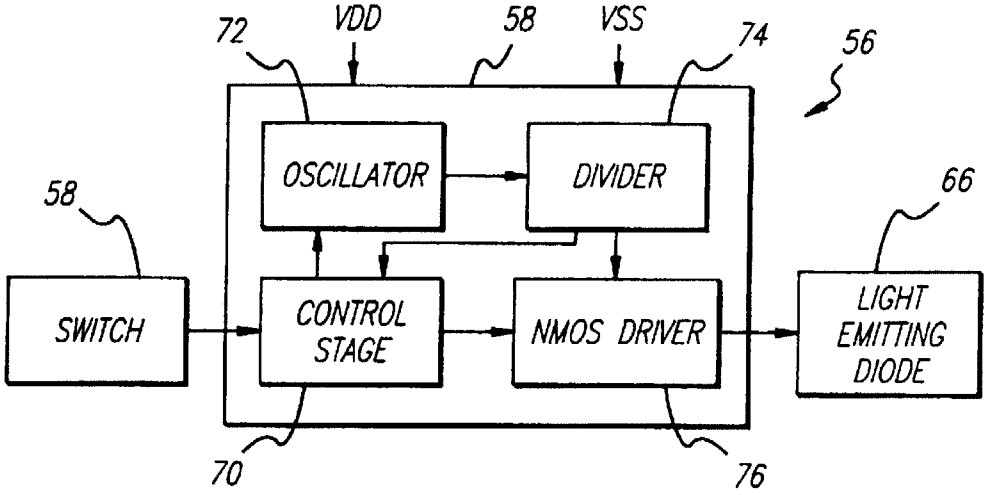
FIG. 5 is a diagram in block form of electrical circuitry included in one embodiment of the invention.

One embodiment of the electrical circuitry 56 is shown in block form in FIG. 5. The electrical circuitry 56 includes the switch 58, the closure and subsequent opening of which produces a triggering signal from a control stage 70. The triggering signal from the control stage 70 in turn initiates the production of alternating signals from an oscillator 72. The signals from the oscillator 72 are divided in frequency by a divider 74 which produces a signal for discontinuing the production of the signal from the control stage 70. During the time that the control stage 70 produces a signal, it introduces the signal to a driver 76 which includes the transistor 60. The output from the control stage 70 energizes the driver 76 so that the signal from the divider 74 can pass to the light emitting diode 66 to illuminate the diode. As will be seen, the diode 66 is energized only for a particular period and as a result only of each closure of the switch 58. For example, the diode 66 may be illuminated for a brief pulse of time.

Figure 6:
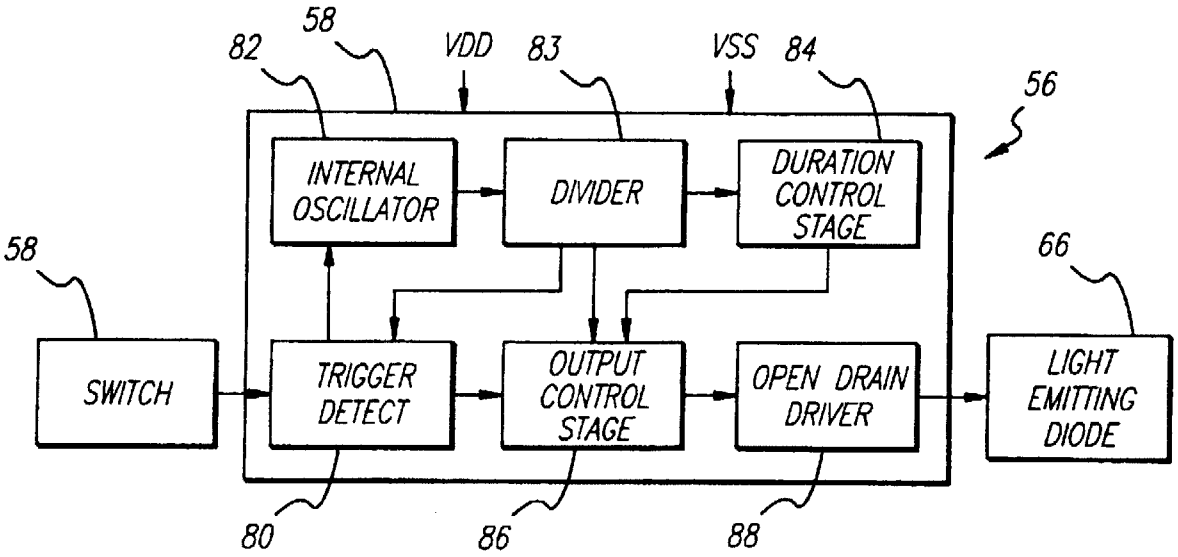
FIG. 6 is a diagram in block form of electrical circuitry included in another embodiment of the invention.

FIG. 6 illustrates another embodiment of the electrical circuitry 56. In this embodiment, the opening of the switch 58 (after closure) causes a triggering signal to be produced by a trigger detect circuit 80. The trigger detect circuit in turn initiates oscillations in an oscillator 82. These oscillations are divided in frequency by a divider 83 which in turn discontinues the operation of the trigger detect circuit after a particular period of time. It will be appreciated that the duty cycle between the successive oscillations (the relative on-off times) may be varied without departing from the scope of the invention.

The output from the divider 83 also passes to circuitry 84 for providing a control over the duration of the signals produced by the electrical circuitry 56. The signals from the duration control stage 84 and from the divider 83 are also introduced to an output control stage 86. The output control stage 86 accordingly passes a signal for a controlled period of time to a driver stage 88 which includes the transistor 60. The driver stage 88 in turn energizes the light emitting diode 66.

In this way, the light emitting diode 66 provides an illumination only for a particular period of time and only as a result of each opening of the switch 58. The circuitry 56 in FIG. 6 may be constructed to produce several oscillations in the diode 66 as a result of each closure of the switch. However, if the switch 58 should again be closed during the oscillatory illumination of the diode 66, the divider 83 introduces a signal to the output control stage 86 to discontinue the production of such signals.

The enclosure 20 may be disposed within a container 100 (e.g. a drinking glass) at the bottom 102 of the container. The cover 18 faces downwardly at the bottom 102 of the container 100. The cover 18 communicates with a button 104 which extends through the bottom wall of the container in a sealed relationship with the container. An additional layer 105 may be disposed at the bottom of the container to insure that the button 104 is in sealed relationship with the container 100.

The button 104 is disposed so as to extend below the exterior surface defining the bottom 102 of the container. When the button 104 is depressed, it causes the switch 58 to open. The switch 58 then becomes closed when the pressure on the button becomes released. Alternately, the switch 58 may become closed when the button is depressed and may become opened when the pressure on the button becomes released.

In one embodiment, the button 104 may become actuated when the container 100 is disposed firmly as by a relatively moderate impact on a support surface 106. This impact is not so great as to damage the container. The impact causes the button 104 to flex the cover 18. In another embodiment, the button 104 becomes actuated when the container 100 disposed on the support surface 106 is filled with a fluid 107 such as water to a particular heighth and is then lifted from the surface.

The light emitting diode 66 may be disposed within the container 100 at the bottom of the container. The light emitting diode 66 is connected to the circuitry within the enclosure 20 to become energized when the switch 58 is closed. Preferably the diode 66 is disposed relatively close to the enclosure 20. When the diode 66 becomes energized, it illuminates as by edge illumination an emblem 108 which is preferably disposed on the side 110 of the container, preferably on the external surface of the container side.

The emblem 108 may be attached to the side of the container by a suitable material such as an epoxy. The emblem 108 may be provided with any suitable pattern. For example, if the container 108 constitutes a beer mug and the beer mug is in a restaurant, the emblem 108 (when illuminated) may advertise the particular beer which is being served by the restaurant or it may advertise the restaurant. Instead of providing illumination or in addition to providing illumination, the circuitry may cause some distinctive sound to be emitted.

The side 110 of the container 100 has a top rim 112. A coupling structure generally indicated at 114 includes a member 116 which is suitably attached as by an epoxy to the top rim 112. The coupling structure 114 also includes a member 118 which is disposed in a co-operative relationship with the member 116 to support a pivot pin 120. The coupling structure 116 is constructed to provide a pivotal movement of the member 118 relative to the member 116 on the pivot pin 120 as a fulcrum.

The member 118 is provided with a substantially flat configuration to support a tab 122 of a lid 124. The lid 124 is provided with dimensions to sit on and cover the rim 112.

An illuminable emblem 128 is disposed on the lid 124. The illuminable emblem 128 may be replaceable on the lid 124 as by providing the lid with a flange 130 and by disposing the periphery of the emblem within the flange. The illuminable emblem 128 may illustratively have a pattern to advertise the fluid (e.g. beer) which is poured into the container.

Another one of the enclosures 20 is disposed on the tab 122 and is suitably adhered to the tab as by an epoxy. This enclosure is designated as 20*a* to distinguish it from the enclosure at the bottom of the container 100. The enclosure 20*a* includes a battery and a switch corresponding to the battery and the switch in the enclosure at the bottom of the container. A light emitting diode 66*a* corresponding to the diode 66 at the bottom of the container extends from the enclosure 20*a*. The light emitting diode 66*a* is disposed relative to the emblem 128 to provide an edge illumination of the emblem 128 when the light emitting diode becomes illuminated.

When an individual wishes to fill the container 100 with a fluid or wishes to drink fluid already in the container, such individual manually grasps the tab 122 to pivot the lid 124 upwardly from the rim 112. The force exerted by such individual manually on the tab 122 causes the switch 58*a* to be actuated. The switch 58*a* can become closed as a result of such actuation so that the emblem 128 becomes illuminated while the lid 124 is being pivoted upwardly. Alternatively, the switch 58*a* can become closed by the diminution of the manual force on the tab 122 after the lid 124 has been pivoted upwardly.

Figure 7:
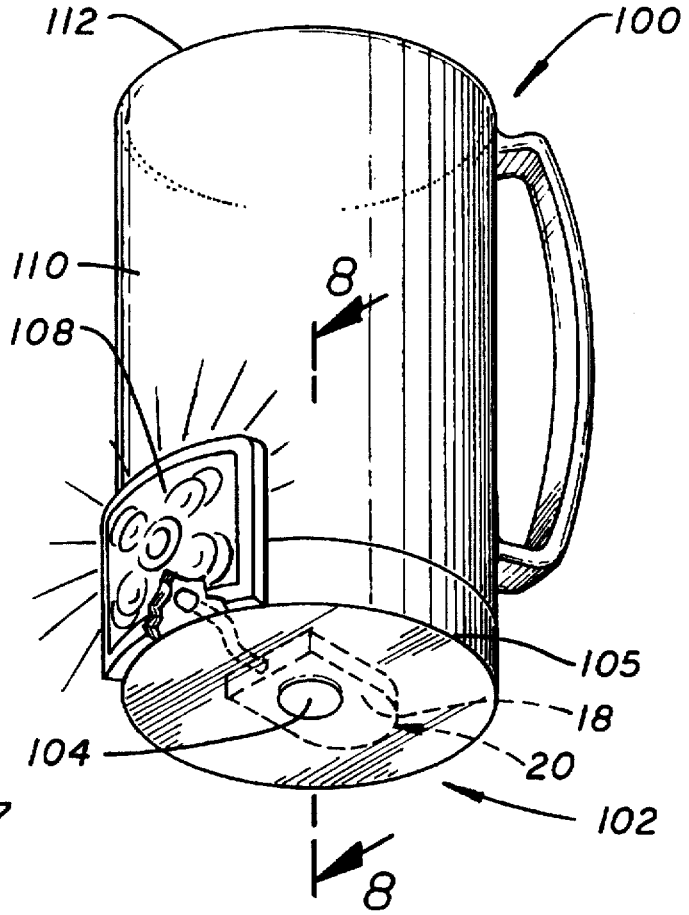
FIG. 7 is a perspective view of an illuminable container constituting one embodiment of the invention.
Figure 8:
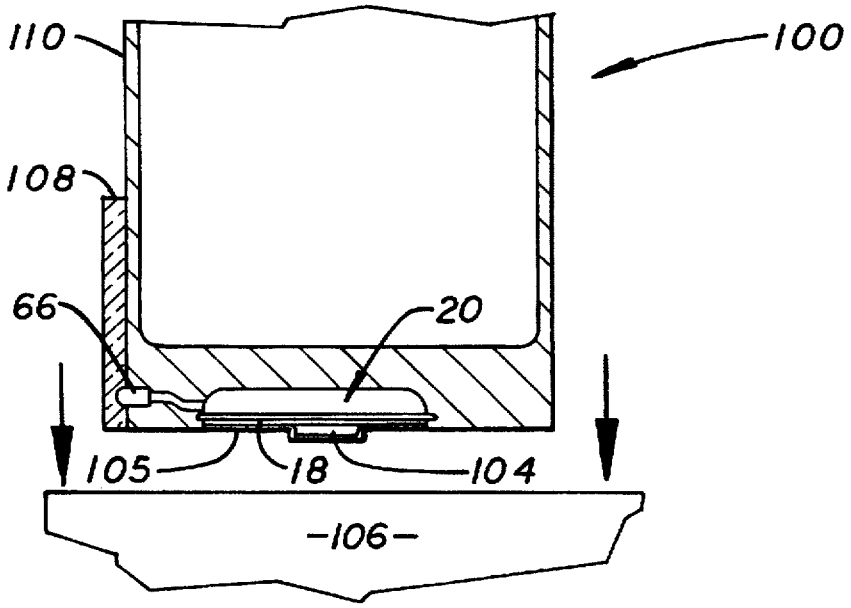
FIG. 8 is a fragmentary sectional view of the container shown in FIG. 7 and is taken substantially on the line 8—8 of FIG. 7.
Figure 9:
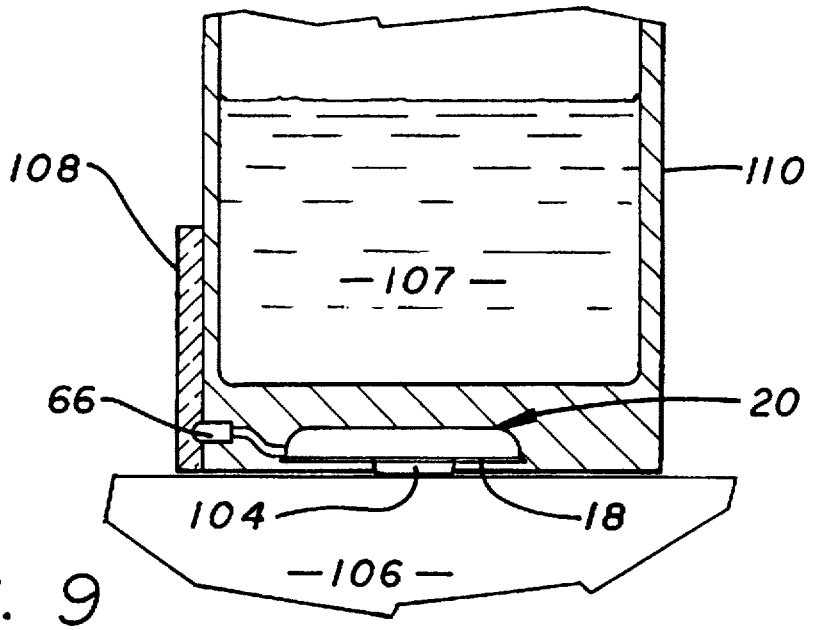
FIG. 9 is a fragmentary perspective view of an illuminable container constituting a second embodiment of the invention.
Figure 10:
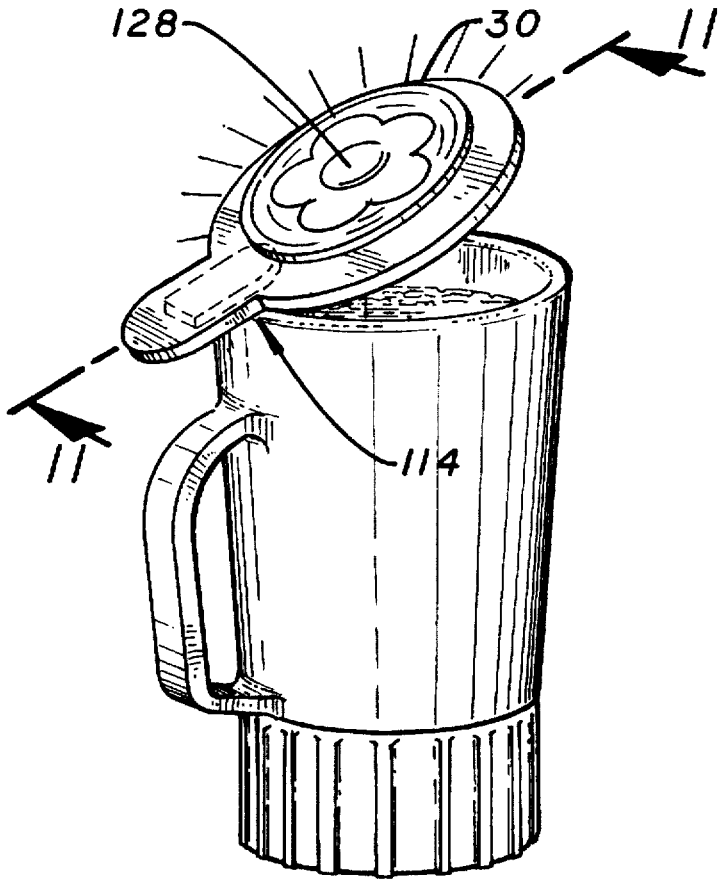
FIG. 10 is a perspective view of an illuminable container and a pivotable lid, the container and the lid being included in still another embodiment of the invention.
Figure 11:
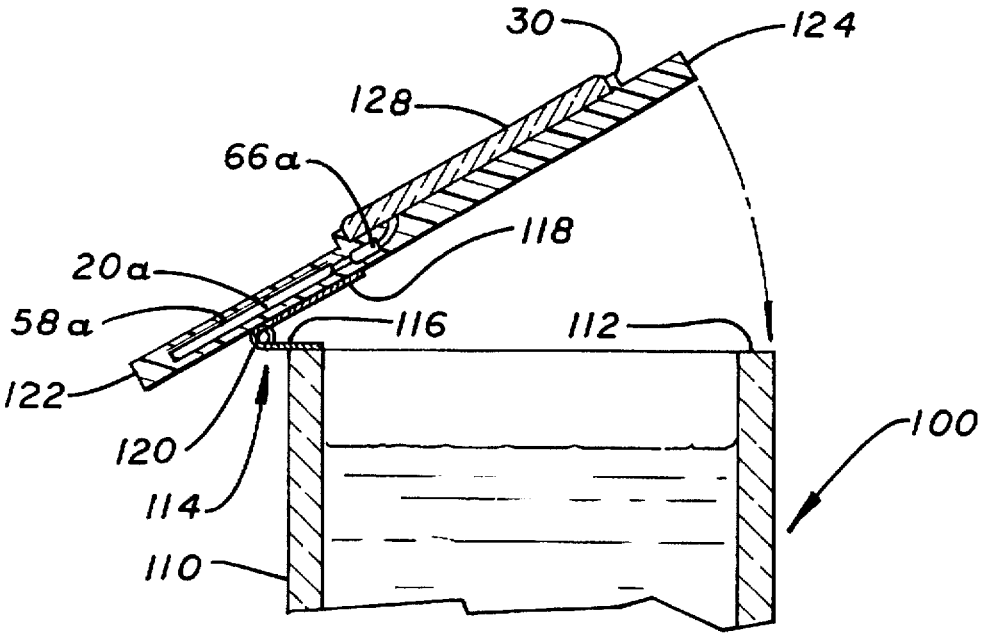
FIG. 11 is a fragmentary sectional view of the container and the lid shown in FIG. 10 and is taken substantially on the line 11—11 of FIG. 10.
Figure 12:
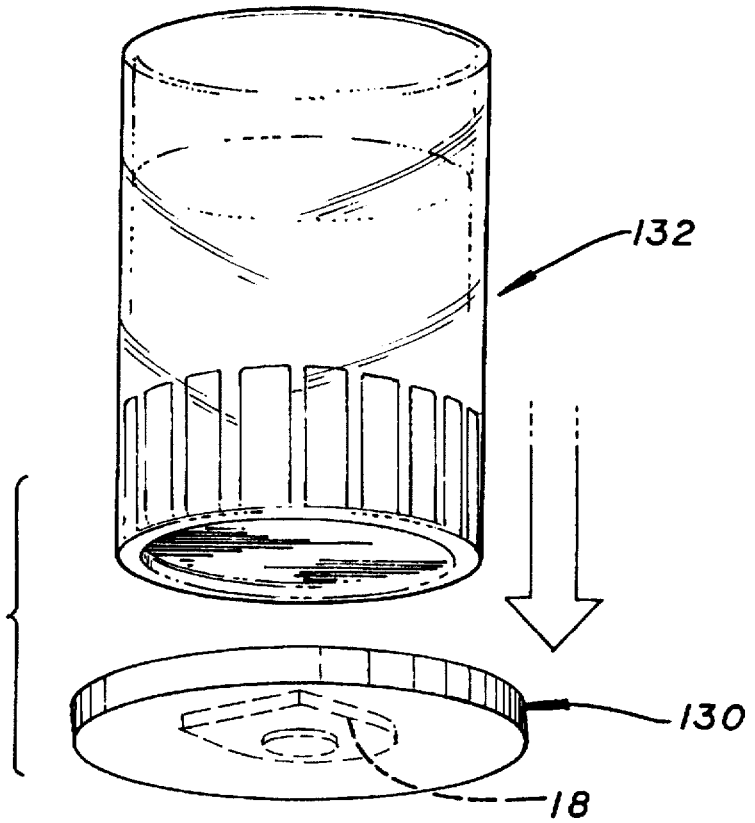
FIG. 12 is an exploded perspective of a third embodiment of the invention, this embodiment constituting a coaster and a container disposed on the coaster.

FIG. 12 illustrates another embodiment of the invention. This embodiment includes a coaster generally indicated at 130 and a container generally indicated at 132 and disposed on the coaster. The coaster 130 may be constructed in a manner corresponding to that shown in FIGS. 7 and 8 for the bottom of the container 100. The container 132 may have the construction of a conventional drinking glass. When the container 132 is disposed on the coaster 130, the coaster becomes illuminated. A portion of this illumination may be transferred to the container 132.

It will be appreciated that the enclosure 20, the button 104, the light emitting diode 66 and the emblem 108 at the bottom of the container 100 can be included in the container 100 whether or not illumination is provided at the top of the container. It will also be appreciated that the enclosure 20*a*, the light emitting diode 66*a* and the emblem 128 at the top of the container can be included in the container 100 whether or not illumination is provided at the bottom of the bottom. However, when illumination is provided simultaneously at the top and the bottom of the container, a synergistic effect can be considered to be produced. Furthermore, the visual effect resulting from the illumination at the bottom of the container can be considered to be enhanced when the container 100 is at least partially filled with a liquid.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. In combination, an illuminable container having a bottom wall and a side wall and constructed to hold a fluid within the container, an enclosure disposed at a bottom of the container, the enclosure including an energy source and a switch having open and closed states of operation, a button disposed externally of the container at the bottom of the container and extending from the bottom wall of the container for depression when the bottom of the container is disposed on a support surface, a light emitting member disposed externally of the enclosure and connected in an electrical circuit with the energy source and a switch to become illuminated in accordance with the opening and closing of the switch, and an emblem disposed on the container to become illuminated in accordance with the illumination of the light emitting member.

2. In a combination as set forth in claim 1, the enclosure being within the container at the bottom of the container and the button extending through the bottom of the container in sealed relationship with the bottom of the container for disposition in co-operative relationship with the switch in the enclosure.

3. In a combination as set forth in claim 2, the enclosure including a resilient cover defining a movable electrical contact of the switch, the switch also including a second contact for engaging the movable electrical contact in accordance with the flexing of the resilient cover, the button extending through the bottom of the container to the resilient cover to flex the resilient cover in accordance with the disposition of the button relative to the support surface.

4. In a combination as set forth in claim 3, the button being provided with characteristics relative to the resilient cover to flex the cover when the container is at least partially filled with a liquid.

5. In a combination as set forth in claim 4, the enclosure being within the container at the bottom of the container and the button extending through the bottom of the container in sealed relationship with the bottom of the container for disposition in co-operative relationship with the switch in the enclosure.

6. In a combination as set forth in claim 4, the illuminable emblem being disposed on the side of the container in contiguous relationship to the light emitting diode.

7. In a combination as set forth in claim 3, the button being provided with characteristics relative to the resilient cover to flex the cover when the container is disposed with at least a particular force on the support surface.

8. In a combination as set forth in claim 7, the enclosure including a resilient cover defining a movable electrical contact of the switch, the switch also including a second contact for engaging the movable electrical contact in accordance with the flexing of the resilient cover, the button extending through the bottom of the container to the resilient cover to flex the cover in accordance with the disposition of the button relative to the support surface.

9. In a combination as set forth in claim 7, the illuminable emblem being disposed on the side of the container in contiguous relationship to the light emitting member.

10. In combination, a container having a bottom wall, a side wall and a rim at a top of the side wall, a member disposed on the rim for pivotal movement on the rim, a lid supported by the member and disposed on the rim for pivotable movement relative to the rim in accordance with the pivotable movement of the member, a cover having a tab for manual engagement to pivot the lid and the member relative to the rim, an enclosure disposed in the tab and including an energy source and a switch having open and closed states, the switch being disposed to be actuated between the open and closed states in accordance with the manual engagement of the tab to pivot the lid and the member relative to the rim, a light emitting member disposed externally of the enclosure and connected in an electrical circuit with the energy source and the switch to become illuminated in accordance with the opening and closing of the switch, and an emblem, disposed on the lid to become illuminated in accordance with the illumination of the light emitting member.

11. In a combination as set forth in claim 10, the lid being shaped for disposition on the rim and being constructed to become illuminated in accordance with the illumination of the light emitting member and to provide a particular display when illuminated.

12. In a combination as set forth in claim 10, the emblem disposed on the cover being replaceable and having characteristics to provide an individual visual indication.

13. In a combination as set forth in claim 10, the enclosure including a resilient cover defining a movable electrical contact of the switch, the enclosure being disposed to provide for a flexing of the cover when the tab is manually engaged to pivot the cover, the switch also including a second contact for engaging the movable electrical contact in accordance with the flexing of the resilient cover.

14. In a combination as set forth in claim 13, the lid being shaped for disposition on the rim and being constructed to become illuminated in accordance with the illumination of the light emitting member and to provide a particular display when illuminated, the emblem disposed on the cover being replaceable and having characteristics to provide an individual visual indication.

15. In a combination as set forth in claim 10, the enclosure including a resilient cover defining a movable electrical contact of the switch, the enclosure being disposed to provide for a flexing of the cover when the tab is manually engaged to pivot the cover, the switch also including a contact for engaging the movable electrical contact of the switch in accordance with the flexing of the resilient cover.

16. In a combination as set forth in claim 15, the lid being shaped for disposition on the rim and being constructed to become illuminated in accordance with the illumination of the light emitting member and to provide a particular display when illuminated, the emblem being replaceable and having characteristics to provide an individual visual indication.

17. In a combination as set forth in claim 1, the light emitting member, the enclosure, the emblem and the switch respectively constituting a first light emitting member, a first enclosure, a first emblem and a first switch, a member disposed on a rim of said container for pivotal movement on the rim, a lid supported by the member and disposed on the rim for pivotable movement relative to the rim in accordance with the pivotable movement of the member, a cover having a tab for manual engagement to pivot the lid and the lid-supporting member relative to the rim, a second enclosure disposed in the tab and including a second energy source and a second switch having open and closed states, the second switch being disposed to be actuated between the open and closed states in accordance with the manual engagement of the tab to pivot the lid and the member relative to the rim, a second light emitting member disposed externally of the second enclosure and connected in an electrical circuit with the second energy source and the second switch to become illuminated in accordance with the opening and closing of the second switch, and a second emblem disposed on the lid to become illuminated in accordance with the illumination of the second light emitting member.

18. In a combination as set forth in claim 17, the lid being shaped for disposition on the rim and being constructed to become illuminated in accordance with the illumination of the second light emitting member and to provide a particular display when illuminated.

19. In a combination as set forth in claim 17, the second emblem being replaceable and having characteristics to provide an individual visual indication.

* * * * *